US005690240A

United States Patent [19]

Thiermann, Sr.

[11] Patent Number: 5,690,240

[45] Date of Patent: Nov. 25, 1997

[54] DOLLY WITH DETACHABLE BOOM

[75] Inventor: William E. Thiermann, Sr., Milwaukee, Wis.

[73] Assignee: Thiermann Industries, Inc., Milwaukee, Wis.

[21] Appl. No.: 690,717

[22] Filed: Jul. 31, 1996

[51] Int. Cl.[6] ..... B66C 23/36

[52] U.S. Cl. ..... 212/180; 212/294; 212/901

[58] Field of Search ..... 212/180, 181, 212/301, 302, 303, 305, 306, 901, 294, 299, 300

[56] References Cited

U.S. PATENT DOCUMENTS

| | | | |
|---|---|---|---|
| 2,699,875 | 1/1955 | Stratton | 212/901 |
| 3,125,350 | 3/1964 | Thiermann . | |
| 3,315,976 | 4/1967 | Thiermann . | |
| 3,494,492 | 2/1970 | Thiermann . | |
| 3,734,540 | 5/1973 | Thiermann . | |
| 3,813,735 | 6/1974 | Thiermann . | |
| 3,987,563 | 10/1976 | Baur | 212/305 |
| 4,527,651 | 7/1985 | Thiermann . | |
| 4,597,498 | 7/1986 | Spinosa et al. | 212/901 |
| 4,700,851 | 10/1987 | Reeve et al. . | |
| 5,120,186 | 6/1992 | Jorgenson | 212/181 |
| 5,221,526 | 6/1993 | Robinette . | |

FOREIGN PATENT DOCUMENTS

| | | | |
|---|---|---|---|
| 989325 | 9/1951 | France | 212/301 |
| 1498511 | 10/1967 | France | 212/180 |
| 1102768 | 7/1984 | U.S.S.R. | 212/306 |
| 1098515 | 1/1968 | United Kingdom | 212/306 |

*Primary Examiner*—Thomas J. Brahan
*Attorney, Agent, or Firm*—Quarles & Brady

[57] ABSTRACT

A portable crane assembly is disclosed including a support that can be selectively coupled to and decoupled from a transport dolly. The support includes a plurality of legs that can support a crane boom independently of the dolly. The transport assembly is used to transport the support and boom independently of other items that require movement such as a transformer.

10 Claims, 3 Drawing Sheets

FIG. 1
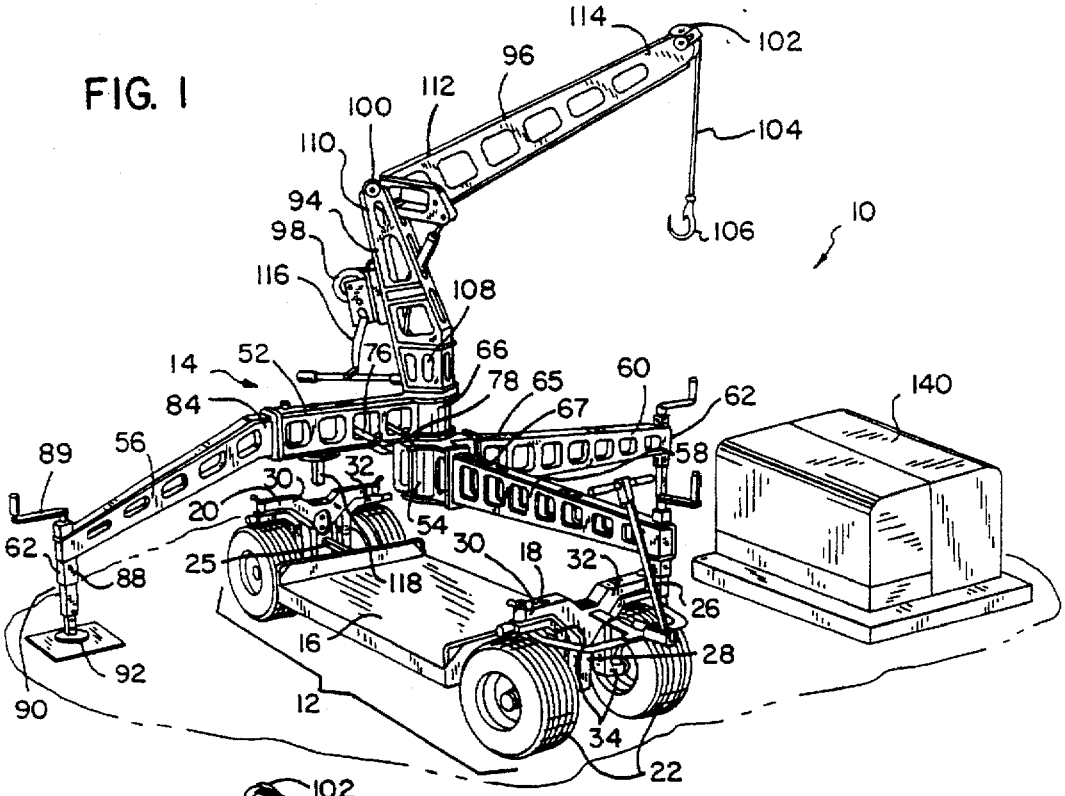
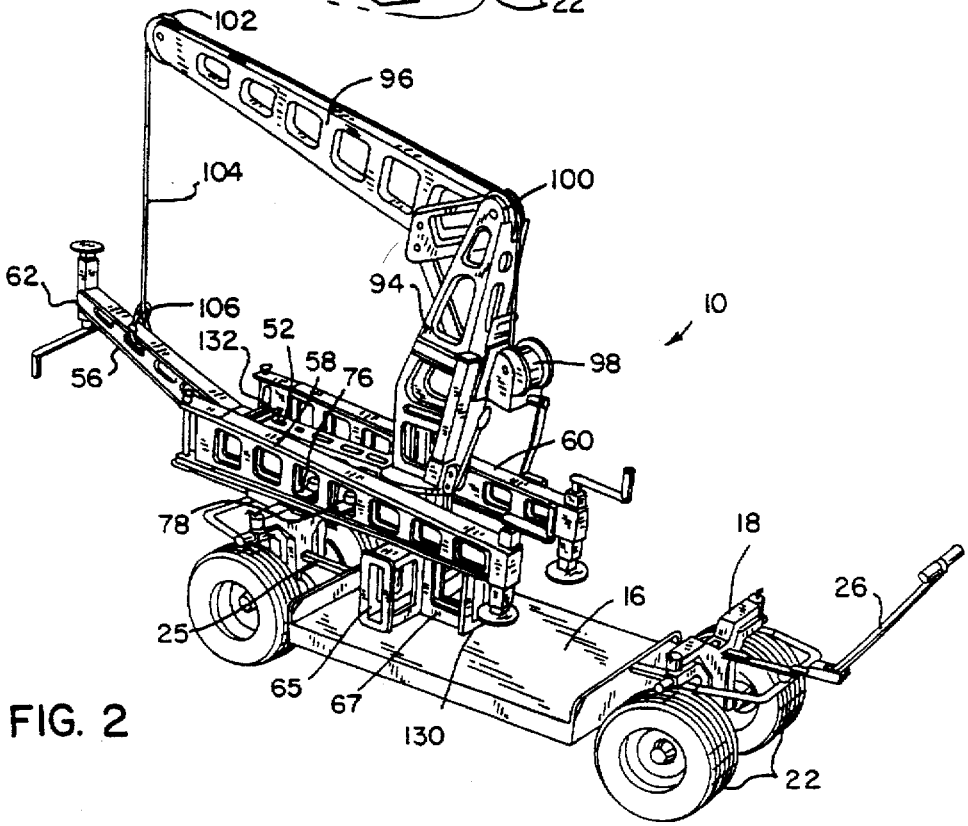
FIG. 2

DOLLY WITH DETACHABLE BOOM

FIELD OF THE INVENTION

The present invention relates to crane assemblies. More specifically it relates to an independently supportable crane assembly and accompanying dolly.

DESCRIPTION OF THE ART

Electrical transformers are extensively used in electrical power systems. For various reasons (e.g. a lightening strike) a transformer can be damaged or destroyed and must be replaced. Such transformers are often extremely heavy. Thus, a truck or dolly is often used to transport transformers to and from installation and replacement sites. In addition, some type of crane is often needed to lift such transformers onto and off of the dolly or truck.

Such transformers are often aesthetically unappealing. Therefore, an effort is often made to position the transformer in an obscure or hidden location. For example, transformers are frequently placed on the edge of a lot line, between bushes or trees.

While obscure placement and landscaping can be used to hide a transformer, this can frustrate transformer replacement. For example, where a transformer is positioned in a landscaped area, the utility easement may be relatively narrow, making it impossible to use a standard truck in the replacement process without damaging the landscape or exceeding the scope of the easement.

One idea to accommodate a narrow easement is described in U.S. Pat. No. 3,494,492. This patent describes an integral dolly/crane assembly for lifting and transporting a transformer or the like. This dolly/crane assembly, unlike a pickup truck, is relatively narrow and can therefore accommodate narrow easements.

Nevertheless, this solution is disadvantageous for at least two reasons. First, even where an easement is sufficiently wide to accommodate this dolly, the path to an installation site will often include travel over delicate ground (e.g. a landscaped area or a marshy area) that cannot support the combined weight of the crane and the transformer without causing deep ruts. Second, the assembly described in this patent includes a bridge type boom which can only operate when access is not highly restricted.

A different approach is described in U.S. Pat. No. 4,700,851. This patent describes a crane assembly that is releasably mountable in the back of a pickup truck or a similarly shaped wide trailer. The truck is used to first transport the crane assembly to an installation site where the assembly is unloaded and set up for operation independent of the truck. The crane assembly is then used to lift the damaged transformer onto the truck. The truck can then be used to haul the damaged transformer away and to transport a new transformer to the site. The crane assembly is then used to remove the new transformer from the truck for placement at the site. Thereafter the crane assembly is again secured to the truck for removal from the site. Thus, the overall weight of the loaded truck never simultaneously includes the combined weight of the truck, crane assembly and transformer.

However, the system described in this patent is disadvantageous for a number of reasons. For example, the weight of a conventional pickup truck and crane assembly (or the truck and transformer alone) may well exceed the weight that can be adequately supported by the property traversed without causing deep ruts. Moreover, these vehicles/trailers will still often be too wide to access narrow easements or access paths (e.g. between trees).

Also, the assembly described in this patent is relatively complex, has limited scope of motion, and requires an extensive procedure to decouple the crane assembly from, and recouple the assembly to, the truck. Further, that crane assembly requires a structure that can make it difficult for the crane to be positioned immediately near the transformer. This system uses a very large boom to try to make up for this. The support structure has an extremely large footprint.

Therefore, it would be advantageous to have a crane transport/support assembly that could accommodate very narrow easements yet have a more limited load weight. In addition, it would be advantageous to have a crane assembly that requires minimal components and does not require a large footprint or additional ballast to maintain stability.

SUMMARY OF THE INVENTION

The present invention provides a portable crane assembly including a crane boom, a supporter coupled to and supporting the boom, a transporter having a transport surface coupled to, and supported by, a plurality of wheels, and a coupler for releasably coupling the supporter to the transporter. The supporter can be coupled to the transporter and positioned in a transport configuration for transporting the supporter and boom, or the supporter can be positioned in a lifting configuration and decoupled from the transporter for supporting the boom independently of the transporter. The overall width of the crane assembly in the transport configuration is less than four feet.

In one aspect of the invention each of the supporter and transporter are sub-assemblies and the coupler includes an essentially vertical extension member connected to one of the subassemblies and a channel formed in the other subassembly, the channel releasably receiving the extension member. Preferably, the channel is formed in the transporter.

In another aspect of the invention, the region directly above the transport surface defines a first area, the supporter includes a swing arm pivotally connected to the extension member adjacent a first end, and the boom is connected to a second end of the swing arm opposite the first end so that the second end can be pivoted on a pivot axis between a position in the first area and a position lateral from the first area which is not directly over the transport surface. The extension member is not axially aligned with the pivot axis so that the dolly system can be positioned immediately next to a transformer even when the crane boom is positioned for use.

In another preferred aspect, the supporter includes at least three legs coupled together supporting the boom when in the lifting configuration. The legs may be releasably couplable.

In another preferred aspect, the plurality of wheels includes four wheels, two of the four wheels are located adjacent a back end of the transport surface and the channel is between the wheels at the back end.

In another aspect, the invention includes a portable crane assembly including a crane boom, a supporter connected to and supporting the boom, a transporter having a transport surface mounted to, and supported by, a plurality of wheels, each of the supporter and transporter being sub-assemblies and a coupler for releasably coupling the supporter to the transporter. The coupler includes an extension member and a channel, the extension member being connected to one of the sub-assemblies and the channel being formed in the other sub-assembly. Here, the supporter can be coupled to the transporter for transport by placing the extension member in the channel via an essentially vertical movement.

It will be appreciated that the crane assembly of the present invention allows a user to first transport the supporter and boom to an installation site, set up the supporter and boom for operation independent of the transporter, and use the transporter to receive a transformer from, or transport a transformer to, the site independent of the boom and supporter. This eliminates the need to subject landscaped or marshy property to the combined weight of the transporter, crane and transformer simultaneously. Moreover, it should also be appreciated that the overall width of the crane assembly, when in the transport configuration, is minimized. This allows use of the assembly even where a relatively narrow easement or path is provided. Also, the assembly is easy to operate.

A primary object of the invention is to provide a combined dolly and crane assembly where the crane and the boom and a supporter are releasable from the transporter/dolly and can operate independently thereof.

Another object is to provide such an assembly wherein the boom and supporter are easily couplable to, and decouplable from the transporter (e.g. by vertical movement).

A related object is to provide a supporter and boom that can be set up and taken apart quickly, thus reducing the overall time required to remove and install a transformer.

Yet another object is to provide a stable moveable crane that does not require additional ballast.

Still other objects and advantages of the present invention will become apparent during the course of the following description and by reference to the accompanying drawings. Thus, the claims should be looked to in order to judge the full scope of the invention.

BRIEF DESCRIPTION OF THE DRAWINGS

FIG. 1 is a perspective view of the crane assembly of the present invention in a lifting configuration;

FIG. 2 is a perspective view of the crane assembly of FIG. 1 in its transport configuration;

DETAILED DESCRIPTION OF THE PREFERRED EMBODIMENT

Figure 3:
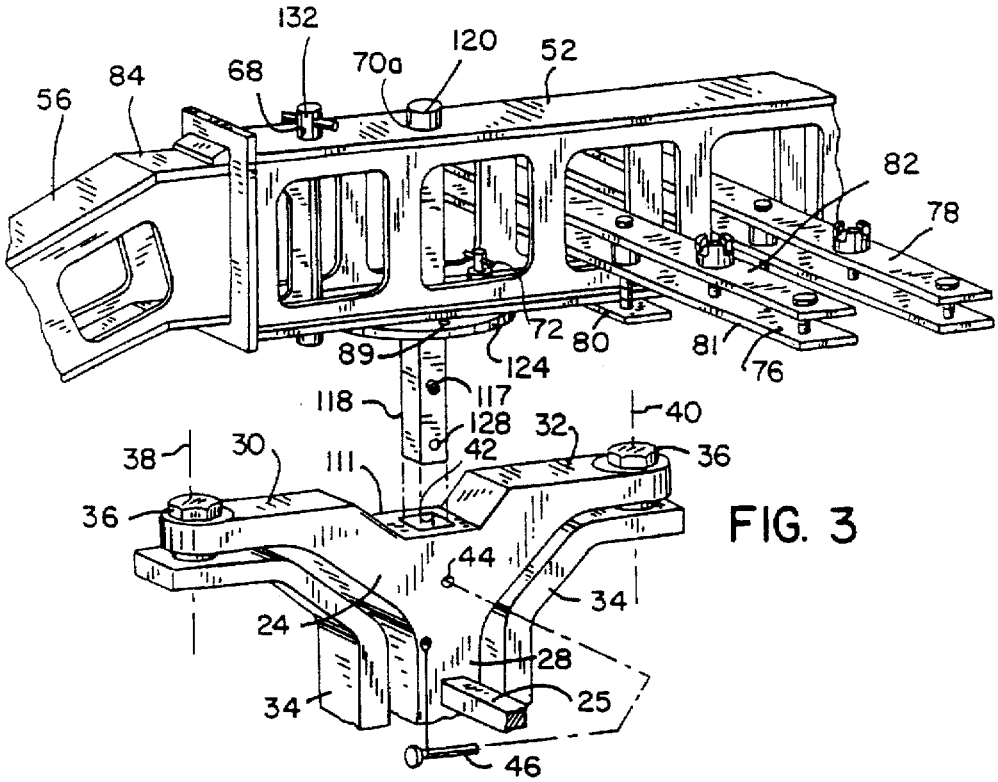
FIG. 3 is a partial perspective view of the vertical coupling means of the FIG. 1 assembly, in a decoupled orientation.

Referring now to FIG. 1, a crane assembly 10 of the present invention includes a transporter/dolly/transport assembly 12 and a boom assembly 14 that can either be coupled to the transport assembly 12 for transporting the boom assembly 14 to and from an installation site, or can be separated from the transport assembly 12 so that the boom assembly 14 and transport assembly 12 can be used independently of each other.

The transport assembly 12 includes three separate sections, a support bed 16 and two separate but identical wheel assemblies 18, 20. A first wheel assembly 18 is connected to a front end of the support bed 16 and the second wheel assembly 20 is connected to a rear end opposite the front end. Each wheel assembly 18, 20 includes two wheels 22. There is a support yoke 24, a handle assembly 26 (only at the front), a horizontally extending bar 25 for securely attaching the support bed 16 to the assemblies 18, 20, and two upwardly curved arms 34. Each yoke 24 has a substantially vertical downwardly extending member 28 and two upwardly and outwardly extending members 30, 32 connected to the top end of the downwardly extending member 28, each of which extends horizontally at its distal end.

Referring to FIGS. 1 and 3, each wheel 22 is connected via an axle to a lower end one of the curved arms 34 to the underside of a separate one of the outwardly extending members 30, 32. Each of the curved arms 34 is connected to an associated extending member 30, 32 by a vertical pintle bolt 36 that allows the arm 34 to rotate about a corresponding vertical axis 38 or 40 so that the associated wheels 22 can be oriented so as to roll in any horizontal direction. A somewhat similar pintle mechanism and the curved arms are described in more detail in U.S. Pat. No. 3,315,976.

Figure 4:
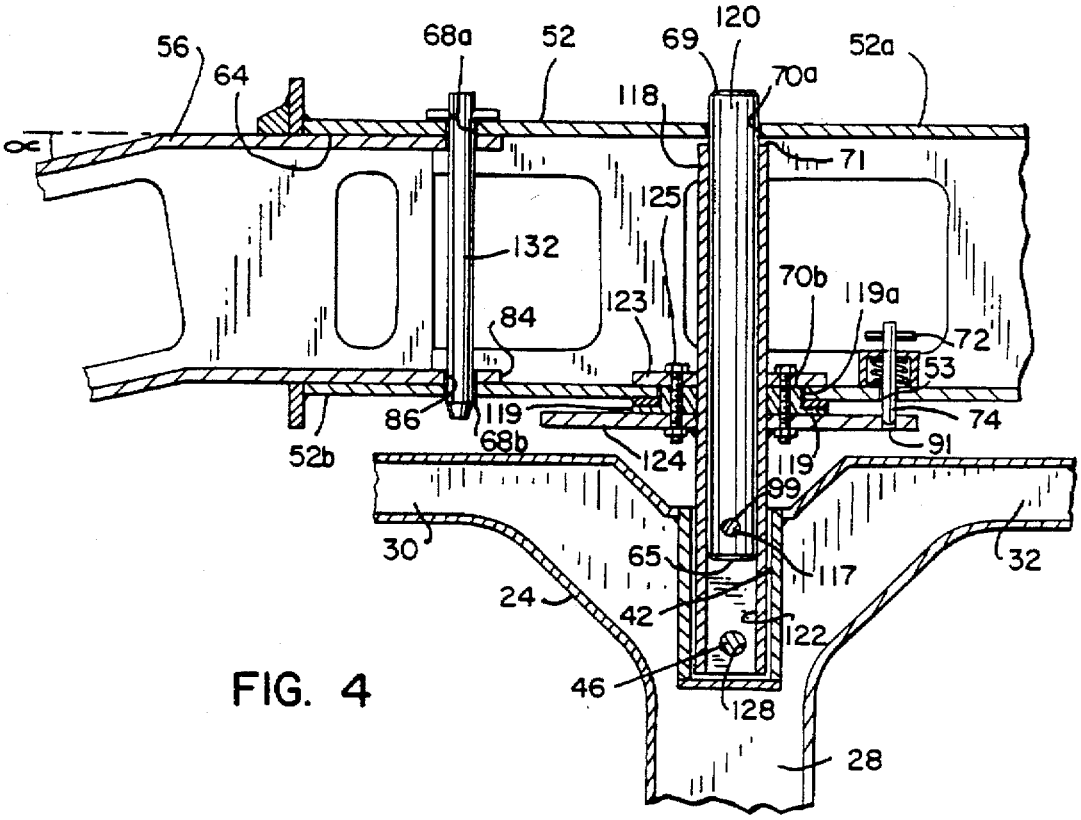
FIG. 4 is a partial cross-sectional view of the coupler shown in FIG. 3, albeit in a coupled orientation.

Referring now more specifically to FIGS. 3 and 4, the downwardly extending member 28 forms a substantially vertical channel 42 between the two outwardly extending members 30, 32. An aperture 44 extends horizontally through the downwardly extending member 28 perpendicular to the outwardly extending members 30, 32, passing through both sides of the yoke 24. A "locking" pin 46 is sized so as to be receivable within the aperture 44.

Referring again to FIG. 1, the boom assembly 14 includes a supporter or support section and a boom section. The support section includes a swing arm 52, an outrigger support 54, first, second and third outrigger legs 56, 58, 60, respectively, and three manually operable extension assemblies 62.

Referring to FIGS. 1, 3 and 4, the swing arm 52 is formed by a substantially vertical lattice type beam forming a first outrigger end or port 64 and forming an upwardly opening cylindrical boom socket 66 at the end opposite the first. The swing arm 52 also includes upper and lower walls **52*a* and 52*b*, each of which forms a port locking aperture 68*a*, 68*b* respectively. The two apertures 68*a*, 68*b* are aligned such that, when a locking pin 132 is inserted therethrough, the pin extends through the space defined by the first outrigger port 64**.

First and second concentrically aligned pivot apertures **70*a*, 70*b* are formed in the swing arm upper and lower walls 52*a*, 52*b*, respectively, adjacent the port locking apertures 68*a*, 68*b* and between the port locking apertures 68*a*, 68*b* and the boom socket 66. The first pivot aperture 70*a* has a diameter that is smaller than that of the second pivot aperture 70*b*. The pivot apertures 70*a*, 70*b* should be spaced such that the frustoconical space between the pivot apertures 70*a* and 70*b* does not interfere with the first outrigger port 64**.

Referring to FIG. 4, a spring loaded pin 72 having a distal end 74 extends downwardly through a hole 53 in the lower wall **52*b* of the swing arm 52. Unless purposefully pulled upward, the spring maintains the distal end 74** in an outward, extended, and locking orientation.

Figure 5:
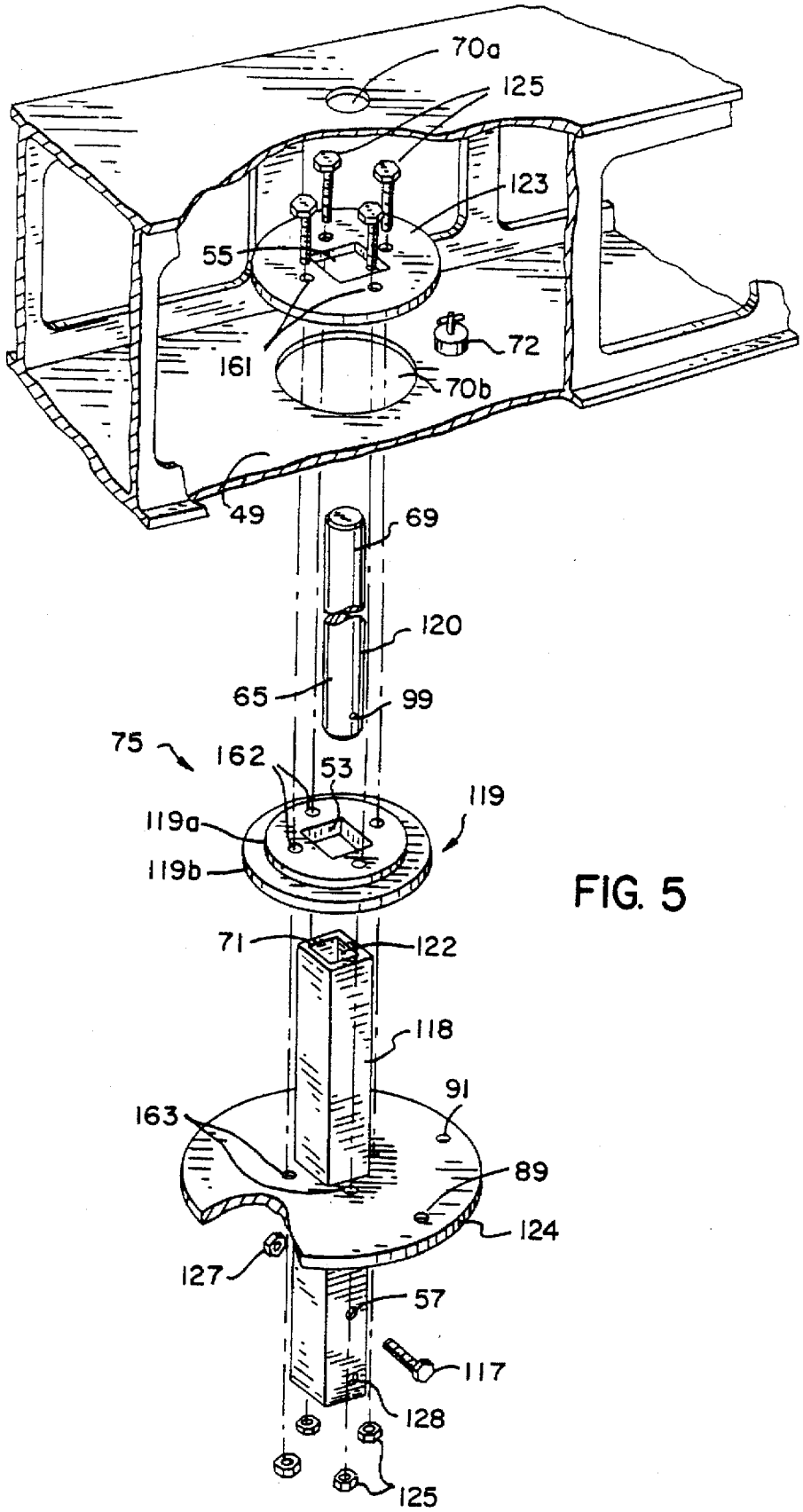
FIG. 5 is an exploded view of the upper portion of the coupling assembly shown in FIG. 4.

Referring to FIG. 5, a coupler assembly 75 includes an extension member or coupler sleeve 118, a pivot post 120, a separator 119, a washer 123 and a plurality of bolts/nuts 125. The coupler sleeve 118, like the channel 42, has a substantially square cross-section and is sized so as to be receivable within the channel 42. The coupler sleeve 118 forms an internal square channel 122 and includes a cylindrical flange 124 extending outwardly from its mid-section.

The sleeve 118 has a hole 57 below the flange 124. When assembled, a bolt 117 extends horizontally through the hole 57 so that a head of the bolt 117 extends outwardly on one side of the sleeve 118 and a nut 127 on its distal end extends from the other side. The sleeve 118 also forms an aperture 128 below the hole 57 that is parallel to the hole 57 and passes through opposite sides of the sleeve 118. The hole 57 and aperture 128 are spaced apart such that when the bolt 117 is secured in hole 57 and the sleeve 118 is received in the channel 42 with the bolt head and nut 127 resting on an upper lip 111 of the channel 42, the aperture 128 is aligned with yoke aperture 44

Referring still to FIGS. 3, 4, and 5, the flange 124 has first and second vertical locking holes 89, 91. Locking hole 89 is formed above aperture 128 and the locking hole 91 is preferably circumferentially separated from the first hole 89 by approximately 90°.

The pivot post 120 is cylindrical and is sized so as to be receivable within the channel 122 and within the first pivot aperture 70*a*. The pivot post 120 has an aperture 99 near its lower end 65 that is sized to pass bolt 117. When assembled bolt 117 passes through aperture 99. Aperture 99 is positioned so that, when bolt 117 passes through apertures 57 and 99, the lower end 65 of the post 120 is above aperture 128 (see FIG. 4).

Referring to FIGS. 4 and 5, each of the separator 119 and washer 123 form roughly square apertures 53, 55 that fit snugly around the external surface of coupler 118. The separator 119 has two outer diameters forming a reduced circular diameter portion 119*a* around a top portion and a greater diameter portion 119*b* there below. The reduced portion 119*a* has a diameter slightly less than the diameter of aperture 70*b* so that when the separator 119 is positioned between the lower swing arm wall 52*b* and the flange 124, the reduced section 119*a* substantially fills the area between the outer surface of the sleeve 118 and the edge of aperture 70*b*. The separator 119 can be formed of any resilient low friction material or, in the alternative, could include a ball bearing to facilitate rotation of the swing arm 52 as described below. Each of the washer 123, separator 119 and flange 124 form holes 161, 162 and 163, respectively, for receiving bolts 125.

To assemble the coupler assembly, the separator 119 is positioned around the sleeve 118 so that it rests on an upper surface of the flange 124 with the greater diameter portion 119*b* contacting the flange 124. The pivot post 120 is positioned in channel 122 and is locked therein by bolt 117 which passes through apertures 57 and 99. When so locked, an upper end 69 of the pivot post 120 extends above an upper end 71 of the sleeve 118. With the washer 123 positioned on an internal surface 49 of the swing arm lower wall 52*b* so that its square aperture 55 is concentric with the lower aperture 70*b*, the sleeve/pivot post assembly 118 and 120 is inserted through the lower aperture 70*b* and square aperture 55 until the pivot post upper end 69 passes through the upper aperture 70*a* and the bottom wall 52*b* rests on the greater diameter portion 119*b* of separator 119.

When so positioned, the bolts 125 are inserted through holes 161, 162 and 163 and secured by associated nuts to loosely clamp the washer 123, separator 119 and flange 124 together. When clamped, the circumferential edge of aperture 70*b* is clamped between the greater diameter portion 119*b* of the separator 119 and washer 123. With the distal end 74 of pin 72 retracted, the swing arm 52 is rotatable around the pivot post 120. With the distal end of the pin 72 forced outwardly via the spring loaded force, when the distal end 74 of the pin 72 is aligned with either the first or second locking holes 89, 91, the distal end 74 is forced therethrough inhibiting further rotation of the swing arm 52 without purposefully pulling up on the pin 72.

Referring now to FIGS. 1, 2 and 3, two outrigger storage brackets 76, 78 are securely attached to the swing arm 52 between the pivot apertures 70*a* and 70*b* and the boom socket 66. These storage brackets 76, 78 are used to support the second and third outriggers 58, 60 when the boom assembly is in the transport configuration. Referring specifically to FIG. 3, each of the storage brackets 76, 78 includes three metal plates 80, 81, and 82 and a plurality of bolts. The first and second plates 80, 81 are used to secure the storage brackets 76, 78 to the swing arm 52. The second and third plates 81, 82 are used to secure the second and third outriggers 58, 60 to the storage brackets 76, 78 respectively. Some of the bolts can be removed to separate the second and third plates 81, 82 for placement or removal of the second and third outriggers.

The outrigger support 54 is connected to the bottom of the boom socket 66 and provides at least two outrigger ports 65, 67 in addition to the first outrigger port 64. Preferably, the second and third outrigger ports 65, 67 are formed so as to support substantially horizontal outriggers and are separated by approximately 90° or slightly more in a horizontal plane. Similarly, the swing arm 52 should extend along a line that is approximately 90° or greater from the second outrigger port 65. As in the case of the first outrigger port 64, the outrigger support 54 forms vertical port locking apertures (not shown) defining a passage through each associated outrigger receiving port 65, 67.

Referring to FIGS. 1, 3 and 4, the first outrigger 56 is formed by a lattice type beam having a proximal end 84 shaped so as to be receivable within the first outrigger port 64. Near the proximal end 84 the first outrigger forms a vertical aperture 86 that, when the proximal end 84 is positioned within the first outrigger port 64, aperture 86 is aligned with the port locking apertures 68*a* and 68*b*. Adjacent its proximal end 84, the first outrigger 56 bends at an angle $\alpha$ with respect to horizontal. A distal end of the first outrigger 56 is securely connected to one of the extension assemblies 62.

Each extension assembly 62 includes a sleeve 88, a hand crank 89, a telescoping arm 90 that extends from the sleeve 88, and a foot member 92 at a distal end of the telescoping arm 90. By rotating the hand crank 89 in a clockwise direction, the telescoping arm 90 can be made to extend from the sleeve 88. Similarly, by rotating the hand crank 89 in the counter clockwise direction, the length of the telescoping arm 90 can be reduced and the arm 90 can be drawn back into the sleeve 88.

Referring still to FIG. 1, the second and third outriggers 58, 60 are substantially identical, each one being formed by a straight lattice type beam having a proximal end shaped so as to be receivable in an associated outrigger port 65 or 67 and a distal end connected to an extension assembly 62. Each of the second and third outriggers 58, 60 forms a vertical aperture at its proximal end. When the proximal end of an outrigger is received inside an associate outrigger port, the vertical aperture is aligned with a port locking aperture and can be attached thereto using a suitably shaped pin. These outriggers 58, 60 attach in a manner identical to that of the first outrigger which is illustrated in FIGS. 3 and 4.

The boom includes a substantially upright jib 94, a jib lever 96, a manual winch drum 98, first and second sheaves 100, 102, a lifting cable 104, and hook 106. The jib 94 has a lower end 108 that is receivable within the boom socket 66 allowing the jib 94 to be rotated about a vertical axis. An upper end 110 of the jib 94 is pivotally connected to a proximal end 112 of the jib lever 96. The first sheave 100 is also connected at the upper end 110 of the jib. The second sheave 102 is connected to a distal end 114 of the jib lever 96 opposite the proximal end 112. The drum 98 is securely connected to the jib 94 between the upper and lower ends 110, 108 respectively. A crank handle 116 is connected to the drum 98 for rotating the drum in either direction.

The cable 104 has a proximal end connected to the drum 98, extends from the drum 98 up over the first sheave 100, along the upper edge of the lever 96 and over the second sheave 102, a distal end of the cable 104 extending downwardly from the second sheave 102. The hook 106 is connected to the distal end of the cable 104. By rotating the drum 98 via handle 16, the length of the cable is altered and thus the height of an object connected to the hook 106 is altered.

In operation, when a utility crew is sent to a transformer site to replace a damaged or destroyed transformer, the crew arrives at the installation site with the crane assembly 10 initially in the transport configuration shown in FIG. 2. Referring also to FIGS. 3 and 4, in this configuration, the coupler sleeve 118 is inserted into the vertical channel 42 until the bolt 117 head and associated nut rests on the upper lip Locking pin 46 is inserted through apertures 44 and 128 to maintain the coupler 118 in channel 42. In the transport configuration, the swing arm 52 and other assembly components are oriented so that the swing arm 52 extends toward the front dolly 18 parallel to the length of the support bed 16. In this orientation, a lower edge 130 of the third outrigger port 67 rests on a central area of the support bed's 16 upper surface. To lock the assembly in the transport configuration, with the swing arm 52 above the bed 16, the distal end 74 of the pin 72 extends down through the first aperture 89. When in the transport configuration, the second and third outriggers 58, 60 are not connected to their associated outrigger ports 65, 67. Rather, the outriggers 58, 60 are secured to opposite sides of the swing arm 52 via the outrigger storage brackets 76, 78.

In addition, in the transport configuration, the jib 94 is rotated within the boom socket 66 such that the jib lever 96 extends back away from the first dolly 18. Furthermore, the proximal end 84 of the first outrigger 56 is received in the first outrigger port 64 and secured therein by a locking pin 132 that extends through aligned apertures 68*a*, 68*b* and 86.

Referring to FIG. 2, in the transport configuration, the first outrigger 56 is orientated so that its distal end extends upwardly. To further secure the boom assembly in a transport configuration, the lower end of cable 106 is wrapped around the first outrigger 56 and hooked to itself. Then the drum 98 is cranked until the cable 104 is taught. Surprisingly in this configuration the width of the assembly can be about thirty-two inches.

With the crane assembly 10 in the transport configuration, the utility crew moves the crane assembly 10 to the transformer site and places the assembly 10 immediately adjacent the transformer. During this operation the weight of the crane assembly includes only the weight of the transport assembly 12 and the boom assembly 14.

When properly positioned adjacent a transformer, the transformer will be positioned on either the right-hand side or the left-hand side of the transport assembly 12. With the crane assembly 10 so positioned, the crew removes the second and third outriggers 58, 60 from the brackets 76, 78. Next, one crew member pulls up on the spring loaded pin 72 so that its distal end 74 is removed from the first locking hole 89 thus allowing the beam member 52 and other components connected thereto to rotate about the pivot post 120. Another crew member grasps the distal end of the first outrigger 56 and pushes downwardly thereon thus lifting the beam member 52 and components connected thereto so that the lower edge 130 of the third outrigger port 67 is lifted off the support bed 16.

To this end it is important that there is some slop in the coupler assembly so that the height of the lower edge 130 can be manipulated by pushing down on the outrigger 16 to different degrees. With the spring loaded pin 72 pulled up, the crew rotates the first outrigger 56 and swing arm 52 around the pivot post 120 until the swing arm 52 is aligned with the outwardly extending members 30, 32 therebelow. When so aligned, the socket 66 should be positioned adjacent a corner of the support bed 16. At this point, the spring loaded pin 72 is aligned with the second hole 91 so that its lower end 74 is forced through the second hole 91 locking the swing arm 52 and other components connected thereto in a desired position.

Next, referring to FIG. 1, the locking pin 132 is removed from the swing arm 52, the first outrigger 56 is removed, flipped over, its proximal end 84 is reinserted into the first outrigger port 64 and the locking pin 32 is reinserted to lock the first outrigger 56 to the swing arm 54 with its extension assembly 62 directed downwardly. The second and third outriggers 58, 60 are secured to the swing arm 52 by inserting their proximal ends in associated outrigger ports 55, 57 and locking them via locking pins with their extension assemblies 62 directed downwardly. It should be noted that during this entire time, the entire boom assembly 14 is totally supported by the pivot post 120 and coupler sleeve 118 anchored in channel 42.

At this point, pin 46 is removed, the crew works together to crank the extension assemblies 62 so that the telescoping arms 90 extend downwardly until the foot members 92 firmly contact a support surface. Continuing, the arms are extended until the coupler sleeve 118 rises out of the channel 42 and the boom assembly 114 is completely decoupled from the transport assembly 12 as seen in FIGS. 1 and 3.

When in the support configuration, the outriggers 56, 58 and 60 define two separate regions. In FIG. 1, a first region is occupied by the transformer 140 between the second and third outriggers 58, 60. A second region is between the first and second outriggers 56, 58 and is initially occupied by the transport assembly 12. Thus, the second outrigger 60 extends between the first and second areas.

The swing arm 52 should be configured so that when the arm 52 is swung up over extension member 32, the lower end 108 of the jib 94 is proximate both the first and second areas. When so configured, the boom can be relatively short and still allow movement of the hook over either of the first or second areas in a stable manner. To this end, preferably, the swing arm 52 length from the apertures 71*a*, 71*b* to a center of the socket 66 is approximately equal to or slightly greater than half the width of the support bed 16. In addition, it is desirable if the arm length 52 is between one-fourth and three-fourths the length of the support bed 16 so that when in the transport configuration, the boom assembly 14 weight is approximately centrally distributed on the support bed 16.

To remove a damaged transformer, one crew member rotates the jib 94 within the boom socket 66 until the jib lever 96 extends above the first area occupied by the damaged transformer 140. The first crew member uses the handle 116 to rotate the drum 98 and lower the hook 106. With the hook lowered, a crew member connects the transformer 140 to the hook 106 by any manner that is well known in the art (i.e. straps, chains or the like). With the transformer 140 connected to the hook 106, a crew member uses the handle 116 to crank the drum 98 until the transformer 140 is at a height above the upper edge of the second outrigger 58.

Next, the crew works together to rotate the jib 94 within the socket 66 in a controlled manner moving the transformer 140 from the space above the first region, over the second outrigger 58, to a space above the second region and over the support bed 16. With the transformer 140 above the bed 16, a crew member uses the handle 116 to rotate the drum 98 and lower the transformer 140 onto the bed 16. With the transformer 140 on the bed 16, the transformer 140 is disconnected from the hook 106.

The crew then uses the transport assembly 12 to move the damaged transformer 140 away from the installation site to a utility truck or the like where the damaged transformer can be removed and discarded. Next, a new transformer is loaded onto the transport assembly 12 and transported to the installation site.

Importantly, when the system is used to move a transformer, the maximum weight of the loaded assembly does not include the weight of the boom assembly 14. The boom assembly 14 remains at the installation site until the new transformer is returned.

When the crew brings a new transformer to the installation site the crew moves the transport assembly 12 back into the position shown in FIG. 1. The crew then connects the hook 106 to the new transformer, uses the handle 116 and drum 98 to raise the new transformer to a height which clears the upper edge of the second outrigger 58, rotates the jib 94 within the socket 66 so that the new transformer passes over the second outrigger 58, and lowers the new transformer. After the new transformer has been appropriately positioned, the transformer is disconnected from the hook 106 and installation is completed.

Referring to FIGS. 1 and 3, to remove the boom assembly 14 from the installation site, the coupler sleeve 118 is aligned with the channel 42. Then, the crew uses the extension assemblies 62 to lower the boom assembly 14 until the sleeve 118 is received in channel 42. With the sleeve 118 fully inserted in channel 42, the locking pin 46 is inserted through aperture 44 and aperture 128, thus locking the sleeve 118 in the channel 42. The crew continues to raise the extension assemblies 62 to their limit. Next, the first, second and third outriggers 56, 60, 58 can be removed from their ports 64, 65, and 67. The first outrigger 56 is again flipped over and its proximal end 84 is received in the first outrigger port 64 and secured therein by pin 132.

A first crew member then pushes down on the first outrigger 56, thus slightly raising the lower edge 130 of the third outrigger port 67 so that it will clear the support bed 16. A second crew member pulls up on spring loaded pin 72 to remove distal end 74 from hole 91. Then, the first crew member uses the upwardly skewed first outrigger 56 to rotate the swing arm 52 about the pivot post 120 until the swing arm 52 extends parallel to the length of and over the transport bed 16. When the beam member 52 is parallel to the length of the bed 16, the spring loaded pin 72 becomes aligned with the second hole 89 and its lower end 74 is forced therethrough locking the swing arm 52 in the transport position. Next, the distal end of the first outrigger 56 is allowed to rise so that the lower edge 130 of the second outrigger port 67 comes to rest on the upper surface of the bed 16.

The second and third outriggers 58, 60 are secured to the swing arm 52 via brackets 76, 78. The cable 104 is extended and the hook 106 is wrapped around the distal end of the outrigger 56 and the hook 106 is hooked back onto the cable 104. The drum 98 is used to tighten the cable 104 until there is no slack therein so that the jib lever 96 and jib 94 are secured. Referring to FIG. 2, at this point, the crane assembly is in the transport configuration and is moved by the crew away from the installation site.

It should be understood that the apparatus described above is only exemplary and does not limit the scope of the invention. Various modifications can be made by those skilled in the art that would fall under the scope of the invention. For example, while the support section 48 of the boom assembly 14 is described as having three outriggers, the present invention also contemplates a support section 48 including four or more outriggers to provide additional support or other supporting configurations. In addition, while the invention is described as being entirely manual, a motor could be provided for driving the dolly, raising and lowering the extension assemblies 62, and/or rotating the drum 98. Moreover, while the preferred assembly includes removable outriggers, the outriggers could be pivotally connected to the swing arm 52 so that they could be rotated between the transport and support configurations without being detached.

Furthermore, the flange 124 may have more than two locking holes 89, 91 so that the swing arm 52 can be locked in other orientations. For example, the arm 52 may swing over extension 30 instead of extension 32 when the transformer is on the other side of the transport assembly 12. Moreover, it should be noted that, as seen in FIGS. 1 and 2, each of the dollies 18, 20 forms a channel 42 suitable for receiving and supporting sleeve 118.

In addition, while the invention is described as including three separate extension assemblies 62, one assembly 62 for each outrigger, clearly, a single extension assembly coupled to the sleeve 118 could be used to raise and lower the entire swing arm 52 and components connected thereto.

To apprise the public of the scope of this invention, the following claims are made.

I claim:

1. A portable crane assembly, comprising:

a crane boom;

a supporter that has at least three legs and a swing arm having first and second ends, the second end coupled to and supporting the boom;

a transporter having a transport surface coupled to, and supported by, a plurality of wheels, a region directly above the transport surface defining a first area; and a coupler including an extension member which is pivotally connected to either the transporter or the first end of the swing arm about a pivot axis and a channel formed by the transporter or the first end of the swing arm, so that when the extension member is received in the channel, the second end can be pivoted about the pivot axis from a position over the first area to a position lateral from the first area which is not directly over the transport surface;

wherein the supporter can be coupled to the transporter and positioned in a transport configuration for transporting the supporter and boom and the supporter can alternatively be decoupled from the transporter and positioned on the three legs in a self supporting lifting configuration supporting the boom independently of the transporter.

2. The assembly of claim 1, wherein the extension member is an essentially vertical extension member.

3. The assembly of claim 2, wherein the channel is formed in the transporter.

4. The assembly of claim 3, wherein there are four of said wheels and two of the four wheels are located adjacent a back end of the transport surface with the channel formed between the wheels at the back end.

5. The assembly of claim 3, wherein when the swing arm second end is positioned lateral from the first area the second end can be adjacent an outer edge of the transport surface.

6. The assembly of claim 5, wherein when the swing arm second end is positioned lateral from the first area the second end can be adjacent an outer corner of the transport surface.

7. The assembly of claim 1, wherein the supporter includes at least three support legs coupled together for supporting the boom when it is in the lifting configuration.

8. The assembly of claim 7, wherein at least one of the legs is releasably couplable to the supporter.

9. The assembly of claim 1, wherein the overall width of the transport surface is less than thirty-five inches.

10. A portable crane assembly, comprising:

a crane boom;

a supporter having at least three legs connected to and supporting the boom;

a transporter having a transport surface mounted to, and supported by, a plurality of wheels, each of the supporter and transporter being sub-assemblies; and a coupler for releasably coupling the supporter to the transporter, the coupler including an extension member and a channel, the extension member being connected to one of the sub-assemblies and the channel being formed in the other sub-assembly;

wherein the supporter can be coupled to the transporter by placing the extension member in the channel by an essentially vertical movement and can alternatively be positioned above the transporter with the legs in a folded generally parallel configuration or pivoted and positioned on the three legs in a self supporting configuration decoupled from the transporter such that the supporter and the crane boom can be used independently of the transporter.

* * * * *